US009415932B2

(12) United States Patent
Van Romer

(10) Patent No.: US 9,415,932 B2
(45) **Date of Patent: *Aug. 16, 2016**

(54) ALL-TERRAIN BERM

(71) Applicant: Basic Concepts, Inc., Anderson, SC (US)

(72) Inventor: Edward W. Van Romer, Sandy Springs, SC (US)

(73) Assignee: BASIC CONCEPTS, INC., Anderson, SC (US)

( * ) Notice: Subject to any disclaimer, the term of this patent is extended or adjusted under 35 U.S.C. 154(b) by 214 days.

This patent is subject to a terminal disclaimer.

(21) Appl. No.: 14/191,638

(22) Filed: Feb. 27, 2014

(65) Prior Publication Data

US 2014/0175093 A1 Jun. 26, 2014

Related U.S. Application Data

(63) Continuation of application No. 11/588,130, filed on Oct. 26, 2006, now Pat. No. 8,662,335.

(51) Int. Cl.

| | |
|---|---|
| ***A45C 7/00*** | (2006.01) |
| ***B65D 88/16*** | (2006.01) |
| ***B65D 90/20*** | (2006.01) |
| ***E03B 11/02*** | (2006.01) |
| ***E03F 11/00*** | (2006.01) |
| ***B65D 88/22*** | (2006.01) |

(52) U.S. Cl.

CPC ..... *B65D 88/1656* (2013.01); *B65D 88/22* (2013.01); *B65D 90/205* (2013.01); *E03B 11/02* (2013.01); *E03F 11/00* (2013.01)

(58) Field of Classification Search

CPC .. B65D 90/205; B65D 88/22; B65D 88/1656; E03B 11/02; E03F 11/00

USPC ..... 220/9.1, 9.2, 9.4

See application file for complete search history.

(56) References Cited

U.S. PATENT DOCUMENTS

| | | | | |
|---|---|---|---|---|
| 1,307,942 | A | 6/1919 | Volters | |
| 2,378,159 | A | 6/1945 | Royer | |
| 2,749,956 | A | 6/1956 | Eldred | |
| 4,064,579 | A | 12/1977 | Winther | |
| 4,136,995 | A | 1/1979 | Fish | |
| 4,356,933 | A * | 11/1982 | Connolly | B65D 88/16 220/495.08 |
| 4,511,286 | A | 4/1985 | Hardacre | |
| 5,090,588 | A | 2/1992 | Van Romer et al. | |
| 5,316,175 | A | 5/1994 | Van Romer | |
| 5,511,683 | A | 4/1996 | Dailey | |
| 5,592,702 | A | 1/1997 | Gillebaard, Jr. | |
| 5,762,233 | A | 6/1998 | Van Romer | |
| 5,924,461 | A | 7/1999 | Shaw et al. | |
| 5,948,250 | A | 9/1999 | Middleton | |
| 6,019,243 | A | 2/2000 | Marino | |
| 6,079,904 | A | 6/2000 | Trial | |

(Continued)

*Primary Examiner* — Fenn Mathew
*Assistant Examiner* — Elizabeth Volz
(74) *Attorney, Agent, or Firm* — J. Bennett Mullinax, LLC

(57) ABSTRACT

A berm for receiving and retaining fluid is provided. The berm includes flexible impervious sheeting shaped to include a floor area surrounded with opposed end and side wall sections forming a containment area. The berm includes a plurality of A-frame braces arranged in vertical positions about the flooring for supporting the end and side wall sections. The retaining and support members are engaged with the brace members and the stabilizer members holding the end and side walls in generally elevated positions and in engagement with the braces forming the containment area.

21 Claims, 10 Drawing Sheets

(56) References Cited

U.S. PATENT DOCUMENTS

| | | | |
|---|---|---|---|
| 6,092,686 | A | 7/2000 | Shaw et al. |
| 6,315,495 | B1 | 11/2001 | Starheim |
| 6,558,769 | B1 | 5/2003 | Chwala |
| 6,561,372 | B1 | 5/2003 | Connolly |
| 6,643,858 | B2 | 11/2003 | Lee |
| 6,742,198 | B2 | 6/2004 | Lee |
| 6,880,720 | B2 | 4/2005 | Van Romer |
| 6,880,721 | B1 | 4/2005 | Barrett et al. |
| 6,953,127 | B1 | 10/2005 | Esser |
| 7,036,676 | B2 | 5/2006 | Christensen |
| 7,188,747 | B2 | 3/2007 | Bennett et al. |
| 8,662,335 | B2 * | 3/2014 | Van Romer ..... B65D 90/205 220/9.1 |
| 2003/0029873 | A1 | 2/2003 | Moffat et al. |
| 2003/0156903 | A1 | 8/2003 | Wiseman et al. |
| 2004/0096276 | A1 | 5/2004 | Startteim et al. |
| 2004/0169041 | A1 | 9/2004 | Van Romer |
| 2005/0051547 | A1 | 3/2005 | Van Romer |

* cited by examiner

ALL-TERRAIN BERM

CROSS REFERENCE TO RELATED APPLICATION

This application is a continuation-in-part of application Ser. No. 11/442,825, filed May 30, 2006 having the same title.

BACKGROUND OF THE INVENTION

The invention is directed to a large capacity transportable berm for use in emergency, temporary or military situations, which is adaptable for use on substantially all-terrain.

Numerous situations arise where transportable berms, containments or flexible bladders are both useful and necessary. A primary use of these is with military operations where fluid, whether it be drinking water, waste water or contaminating materials such as petroleum and other similar products, need to be contained for storage or later proper disposal. Disaster areas also require the use of containments for the temporary storage of the above referred to fluids. Finally, in areas of extremely fast growth, there sometimes is a need for a temporary containment.

The instant invention has for a primary object a transportable containment capable of retaining large volumes of fluid for later distribution or disposal.

Another object of the invention is a transportable berm which can be easily and quickly assembled or disassembled.

Another object of the invention is a transportable berm capable of retaining large volumes of fluid over an extended period of time.

Another object of the invention is a system which includes a transportable berm capable of receiving and supporting a filled bladder against rupture and spillage.

Another object of the invention is a transportable berm constructed with a splash guard to prevent unwanted spillage.

Another object of the invention is a system for preventing rupture and spillage of a fluid containing bladder.

Another object of the invention is a large capacity berm which is capable of being easily disassembled and folded or arranged in small units for storage and transport.

SUMMARY OF THE INVENTION

The invention is directed to a transportable all-terrain berm for collecting fluid. The berm is comprised of flexible impervious sheeting material configured to form a floor, which may be supported in a generally horizontal position, and opposed side and end wall sections which are connected along first edges with the floor and together along opposed ends. Retaining members are arranged to extend from second edges of the side and end wall sections at selected spaced positions. Also, support members are arranged to extend from the second side edges of the side and end wall sections at locations between the retaining members.

A plurality of braces, preferably A-frames, are positioned about the flooring in generally vertical positions. Each brace or A-frame comprises first and second legs pivotally engaged at least one of their upper ends. A spacer member is provided for selectively positioning and maintaining the lower ends of the first and second legs in spaced positions. A hook member may be located on an outer surface of one of the first and second legs adjacent its upper end for engagement with a retaining member.

The retaining members comprise loops formed of straps which are affixed with the side sections adjacent the side edges spaced from the floor. The loops engage over the upper ends of said brace members and with the hook members.

The support members comprise straps affixed adjacent the second side adjacent of the side and end members which are formed into loops, which are arranged between adjacent of the support members. Alternatively, the support members may comprise flexible sheeting extending from the second edge of the end and side members which are formed into an extended loop which extends between the retaining members.

A stabilizer, generally comprising a rod having down-turned ends, is engaged with upper ends of the braces interconnecting adjacent ones. The support members are engaged over the stabilizers.

The A-frames may be spaced at generally between 2 and 6 foot intervals, depending upon the weight of the product, along said side and end wall sections with spacings at the corners being slightly less.

The berm is a collapsible berm capable of being folded for storage and transport. The berm is also capable of being assembled to form a containment area for collecting or storing fluid. The containment area, which is formed of flexible impervious sheeting, includes a generally flat floor area surrounded by opposed generally vertical side and end walls. A plurality of braces are arranged in vertical positions about the flooring in position to engage with the end and side walls. There are retaining members and support members which are engaged with and positioned outwardly of and about the end and side walls.

Stabilizer members, which engage with and extend between adjacent of the braces, are adapted to engage with the support members to assist in maintaining the side and end walls in generally vertical positions.

The braces are preferably formed of U-shaped metal beams pivotally joined. Side sections of the metal beams overlap and form the pivot. An opening is formed adjacent the upper end of the braces which is designed to receive the down-turned ends of the stabilizer members.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
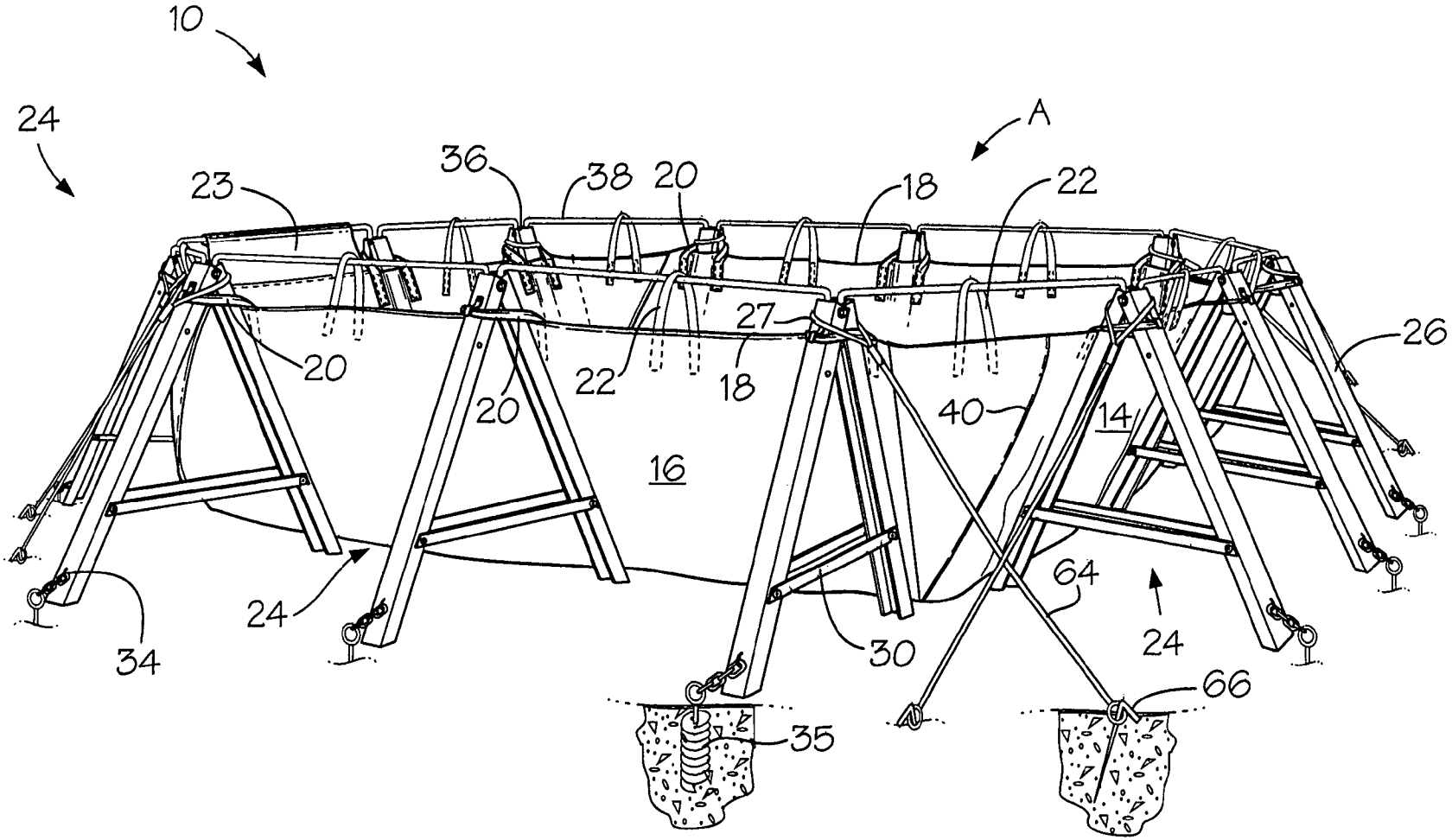
FIG. 1 is a perspective view of the all-terrain berm in assembled condition.

Turning now to FIG. 1, a primary version of the all-terrain berm or ATB transportable containment berm of the invention is shown in its assembled position at 10. Berm 10 is formed of flexible impervious sheet material, usually a fabric coated with synthetic material. The berm comprises a containment area A which includes a floor 12, see FIG. 5, opposed end walls 14 and opposed side walls 16, each engaged along their inner edge with an edge of flooring 12 and along opposed edges with each other forming containment area A. End and side walls are preferably of equal height of between 2 feet and 4 feet. Retaining members 20 are secured adjacent outer edges 18 of side and end walls 14 and 16 in substantially equally spaced positions. Between retaining members 20 and along edges 18 there are provided support members 22 and/or 23.

Figure 4A:
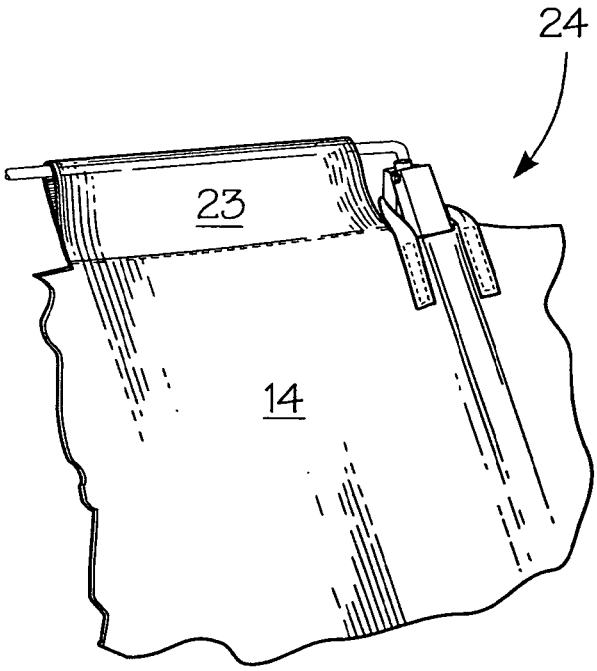
FIG. 4A is an exploded view of a retaining and support member engaged with an A-frame and stabilizer member.
Figure 4B:
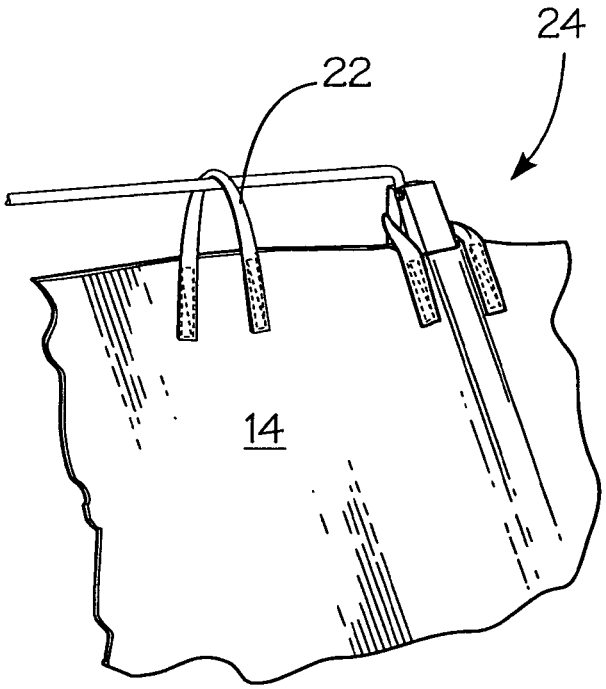
FIG. 4B is an exploded view of another arrangement of a support member and a retaining member engaged with an A-frame and stabilizer member.

Both retaining members 20 and support members 22 may comprise straps secured adjacent their opposed ends with end and side walls 14 and 16 forming loops which extend beyond edges 18. The straps are generally woven and are of a heavier material than the flexible sheet material. Alternatively, the support members may comprise an extension of the flexible sheet material extending between adjacent retaining members 20 and formed into a loop as shown at 23. See also FIGS. 4A and 4B.

The flexible sheeting material may comprise a fabric, formed of natural or synthetic materials which may be woven, knitted or non-woven which is coated with a synthetic material. The coating material must be resistant to degrading when contacted with petrochemicals or other contaminants which are desired to be retained. Polyurethane is generally a suitable coating. The flexible sheeting must be of sufficient strength to resist tearing under the pressure created by the contained fluid. The flexible sheeting must also resist undue wear due to the berm being set up and taken down repeatedly. Suitable fabrics are manufactured by several known manufacturers, two of which are the Seaman Corporation of Wooster, Ohio, and Cooley, Inc. of Pawtucket, R.I.

A plurality of braces 24 or A-frames, best seen in FIGS. 1-3B, are provided to assist in retaining the side and end walls 14, 16 in generally vertical positions. Each brace 24 preferably comprises an A-frame comprised of a pair of U-shaped metal beams 26 joined adjacent upper ends with a pin 28 forming a pivotal connection. Adjacent the lower ends of beams 26 there is provided a spacer 30 which, when engaged with spaced beams 26, maintains them in fixed position.

Beams 26 include spaced and parallel side edges 32 through which bores pass to receive pins 28 and 29 which secure the A-frame in position. Pin 29 may be used to also secure spacers 30 in positions parallel with beams 26 when the brace is in its collapsed position for storage or transport.

Adjacent lower ends of beams 26 an additional bore 34 is provided to receive an anchor which acts to secure brace 24 in fixed position with the ground or its supporting surface. The anchor may comprise a peg or screw pin passed through bore 34 and into the ground or support surface. Alternatively, the anchor may comprise a cord or chain secured at one end with beam 26 and at its other end with peg or screw 35, which is then embedded in the ground as shown in FIG. 1.

Adjacent the upper end of brace 24 is provided a hook 27 or other suitable securing member. Also, adjacent the same upper end, overlapping parallel sides 32 of beams 26 form an enclosed opening 36.

Rods having down-turned opposed ends form stabilizers 38. Each stabilizer is preferably formed to be between 2 and 6 feet in length with the down-turned ends being between 4 and 6 inches in length. The stabilizers, which are located at the corners of the containment, may be slightly shorter than the stabilizers extending along the end and side wall sections, i.e. between 1.5 and 4.5 feet depending on the placement of the braces 24.

Figure 2A:
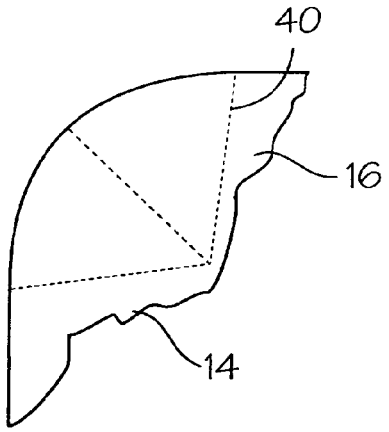
FIG. 2A is a sectional top view of the corner structure of the flexible sheeting.
Figure 2B:
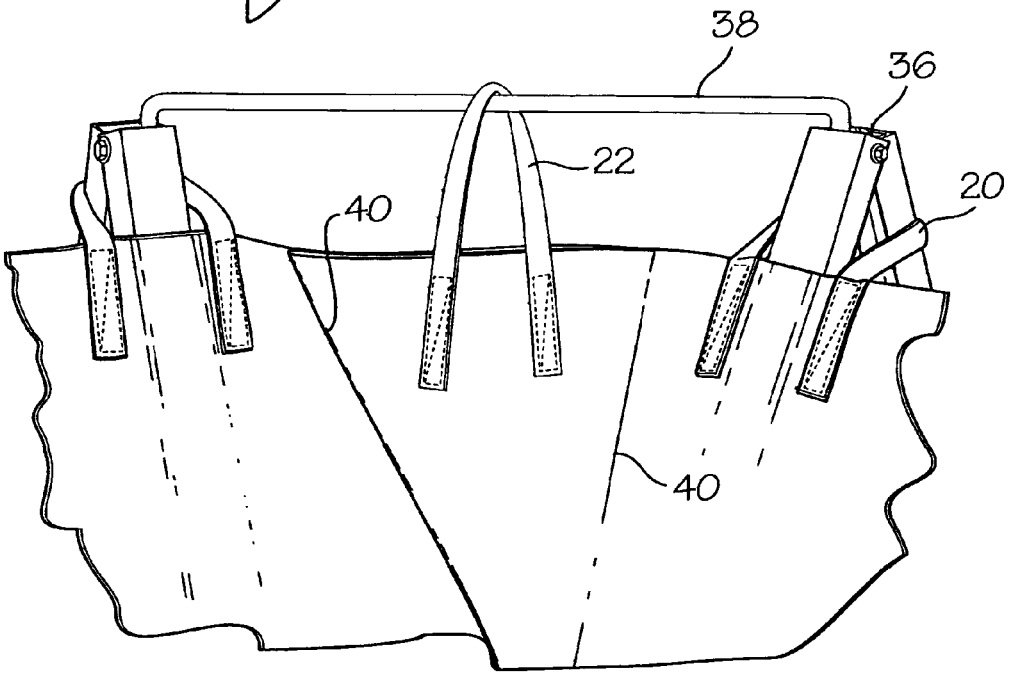
FIG. 2B is a sectional side view of a corner section formed by the end side walls.
Figure 3A:
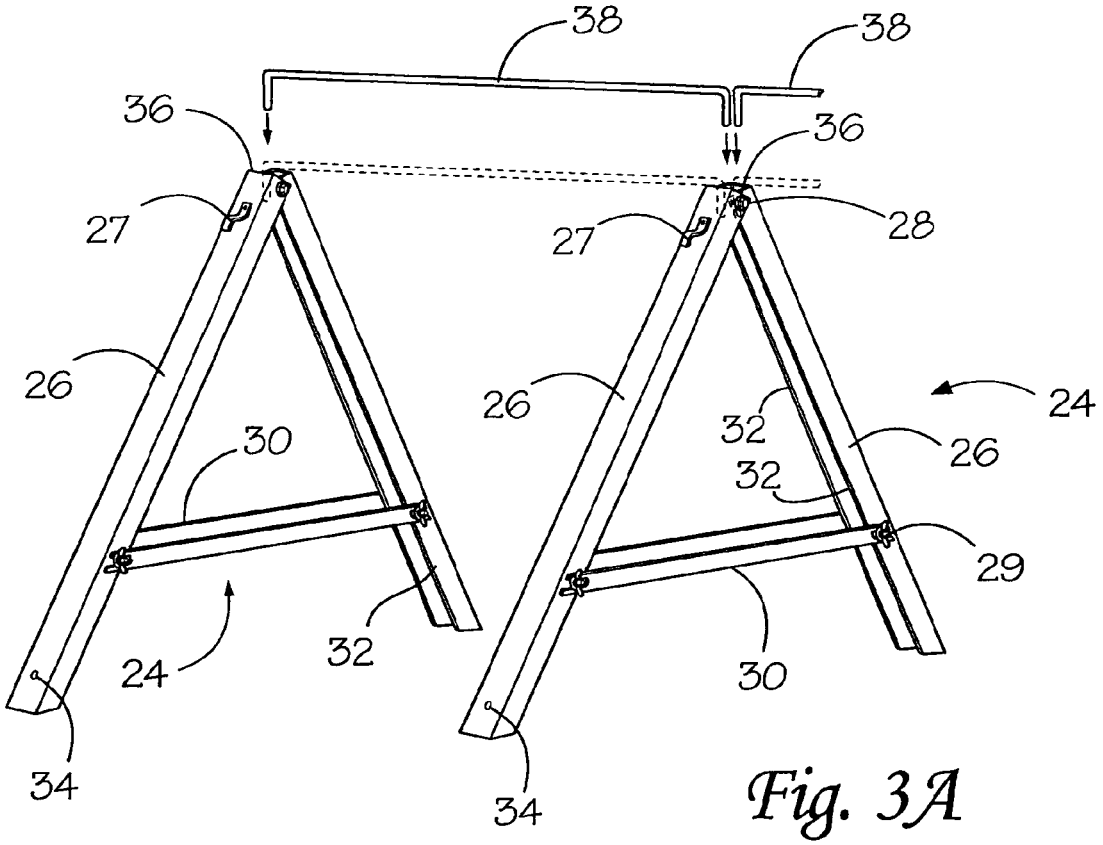
FIG. 3A is a perspective view of a pair of A-frames associated with a stabilizer member.
Figure 3B:
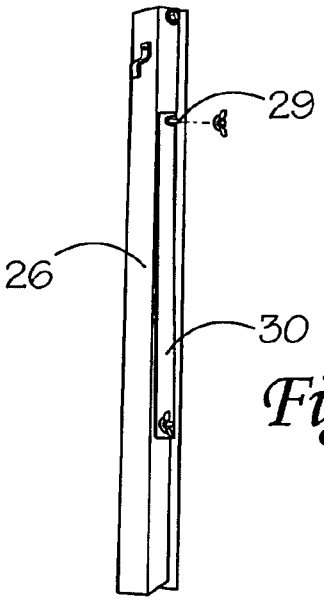
FIG. 3B is a side view of an A-frame in folded condition.
Figure 5:
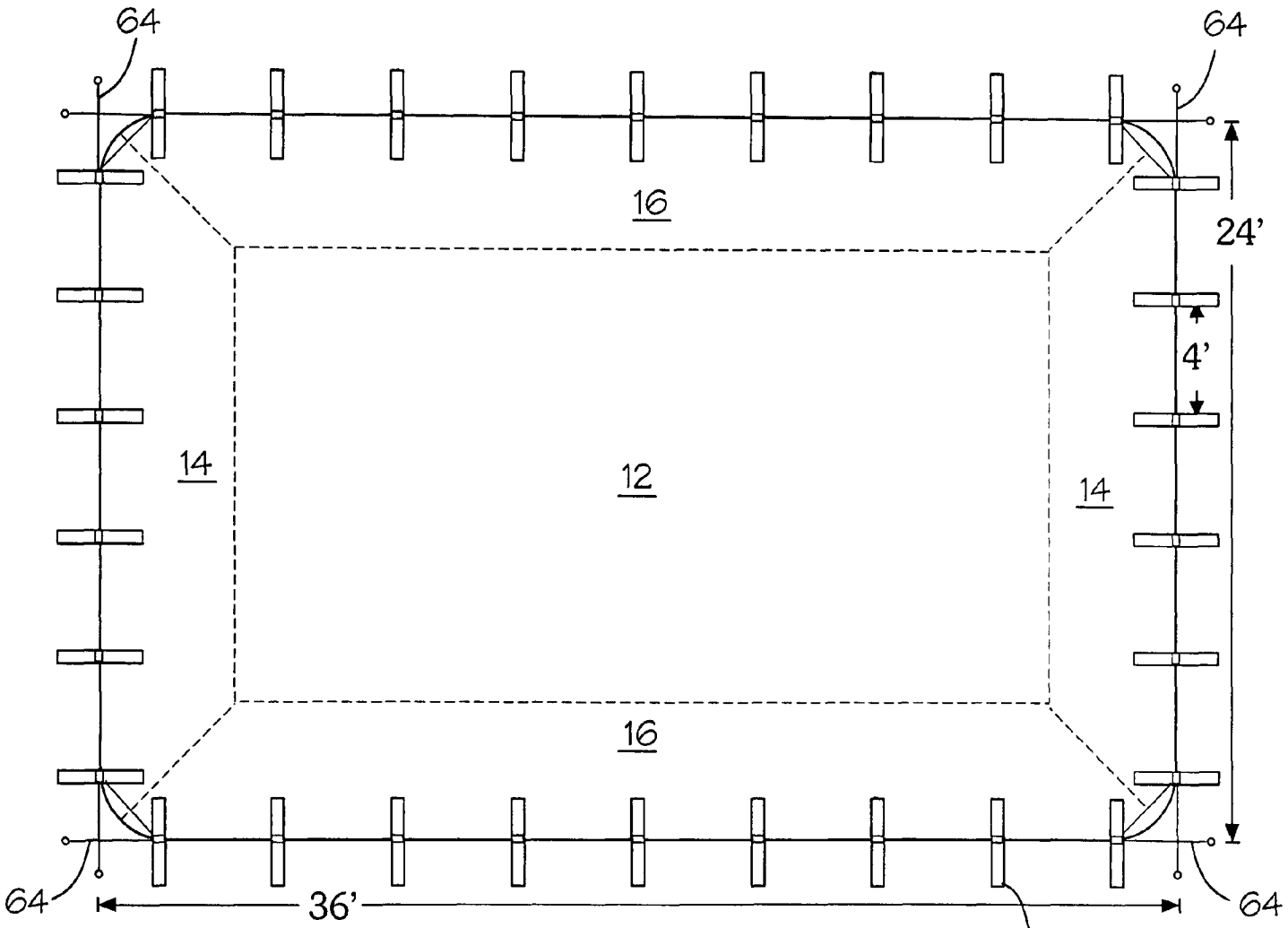
FIG. 5 is a top diagrammatic view of the assembled berm.

The corner sections are slightly rounded and are shown in FIGS. 2A, 2B and 5. Each corner is formed by folding excess of the flexible sheet material, to overlap and then heat sealed along lines 40 as shown in FIG. 2B. A support member 22 may be attached along this section to retain the corner in the vertical position as shown.

Additionally, secondary bracing in the form of two straps or rods 64 which are attached at each corner may be necessary when large volumes of fluid are contained. These straps are connected over the upper pivoted end of braces 24 which are adjacent the corners. The straps are drawn downwardly and away from containment 16, where they are secured with the ground or support surface by spikes 66.

It is noted that the corner forming arrangement of the flexible sheet material forms no part of the instant invention and any known corner forming arrangement is acceptable.

Turning now to FIGS. 1 and 5, a perspective view and a top view of the general arrangement of the berm of the invention is shown. Braces 24 are preferably arranged in equally spaced positions, i.e. between about 2 to 6 feet apart, along both the side and end walls 14, 16. Braces 24 are positioned about 2 feet from each corner section. Stabilizers 38 are engaged in openings 36 adjacent the top of the braces. Flexible sheeting, with dimensions of about 24'×32', is positioned within the arranged braces 24 with side and end walls 14, 16 in engagement with inner legs 26 of braces 24. It is noted these dimensions may be larger or smaller as desired. Retaining members 20 are secured over the upper ends of the braces and in engagement with hook 27. Also, support members 22 or 23 are engaged over stabilizers 38. The retaining members and support members act to hold the end and side walls in a generally vertical position and in engagement with the inner leg of brace members 24. Stabilizers 38 further act to maintain the braces in vertical positions. Straps or rods 64 secure with braces 24 adjacent each corner section to provide additional support for these areas.

Berm 10 is designed to be arranged in a disassembled condition for transport and storage. In the disassembled condition, the flexible sheet forming the flooring and the end and side walls is folded into a generally flat, generally rectangular or square condition which can be accommodated in a minimum space. The braces are put in closed position with the legs in parallel engagement. The braces, along with the stabilizers, are then arranged together and located with the flexible sheeting.

In this disassembled condition, berm 10 may be transported to a point of need where the flooring of the flexible sheet is laid out on the available terrain. The braces are assembled into their A-frame configuration and positioned about the periphery of flooring 12. The stabilizers 38 are engaged with frames 24 fixing them in position. The side and end walls are brought up into their generally vertical position and the retaining and support members are engaged with the braces and stabilizers securing the side and end walls in substantially vertical positions. In this condition, berm 10 is assembled.

It is to be noted that it may be desirable to attach a cover sheet with the upper edges of the side and end walls. The cover sheet may be permanently or removably attached at one or a multiple of edges. The cover is desirable when protecting the content of the bladder from airborne impurities and debris. The cover is especially desirable when drinking water is being stored. The cover sheet is generally of the same material as the material forming the berm.

Figure 6:
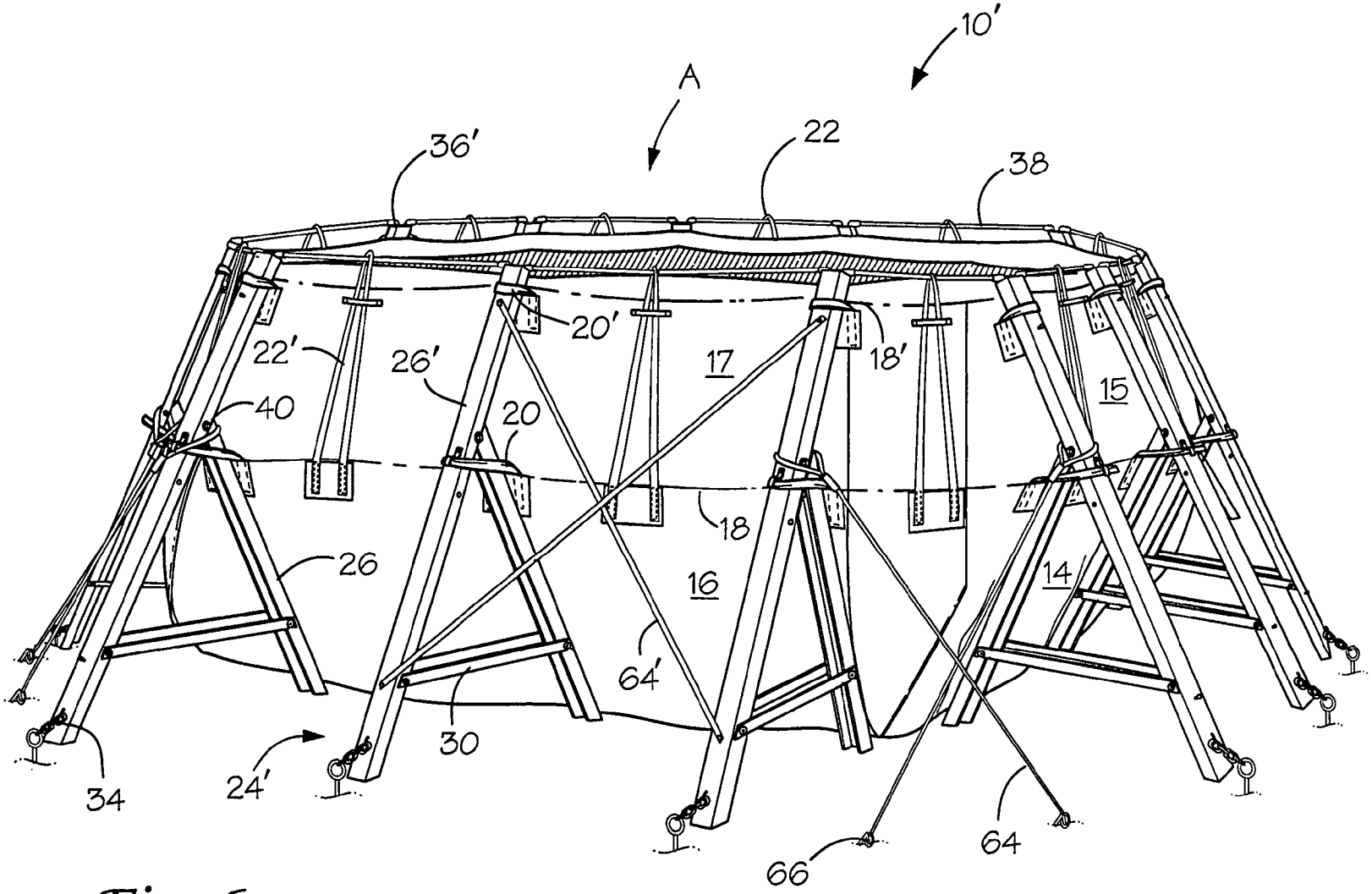
FIG. 6 is a perspective view of an alternative arrangement of the all-terrain berm of the invention.

Turning now to FIG. 6, an alternative arrangement of the berm is shown at $\mathbf{10}^1$. Berm $\mathbf{10}^1$ is substantially of the identical structure as the earlier described berm 10 with the exception that end and side walls 14 and 16 have attached along their upper edges 18 side and end wall extensions 15 and 17 which are of an equal height of between 1 foot and 3 feet. Retaining members 20 may be provided as in berm 10 along with secondary retaining members $\mathbf{20}^1$ which are secured in selected locations adjacent the upper edge of wall extensions 15, 17. Support members $\mathbf{22}^1$ are secured adjacent upper edge 18 and are of a length to extend beyond edge $\mathbf{18}^1$. The support members may be engaged with extensions 15 and 17 adjacent the upper edge with any suitable means as shown in the drawing.

A-frames or braces $\mathbf{24}^1$ are provided to support or retain containment $\mathbf{10}^1$ in an operative condition substantially as in FIG. 1. Each brace $\mathbf{24}^1$ includes an inner leg 26 and an outer leg $\mathbf{26}^1$. Inner leg 26 is as earlier described while outer leg $\mathbf{26}^1$ is lengthened by a length substantially equal to the height of extensions 15 and 17. The upper end of legs $\mathbf{26}^1$ are closed to form a receiving and retaining area for the turned down ends of stabilizer rods 38. Leg 26 is pivotally connected with leg $\mathbf{26}^1$ at 40 which is substantially the same point longitudinally that legs 26, $\mathbf{26}^1$ are pivoted together. Spacer 30 is provided to lock brace $\mathbf{24}^1$ in the upstanding position. Stabilizers 38 and retaining members 20 are engaged with braces $\mathbf{24}^1$ as earlier described while retaining members $\mathbf{20}^1$ are engaged over upper ends of legs $\mathbf{26}^1$ and supports $\mathbf{22}^1$ engage with the stabilizers to hold end and side walls 14, 16 along with extensions 15 and 17 in a generally elevated position. The outer sides of the walls and extensions in their generally vertical positions engage against legs 26 and the upper portion of extension $\mathbf{26}^1$. Due to the angle of the inner and outer legs, the end and side walls are held in a slightly concave position.

Straps or rods 64 may be utilized to support the corners while rods $\mathbf{64}^1$ may be engaged with adjacent braces $\mathbf{24}^1$ for additional stabilization of the brace members. It is noted that in certain conditions, a single pair of rods $\mathbf{64}^1$, secured along each end and side wall, may sufficiently stabilize the braces. These straps or rods may also be used in the arrangement shown in FIG. 1.

Figure 7:
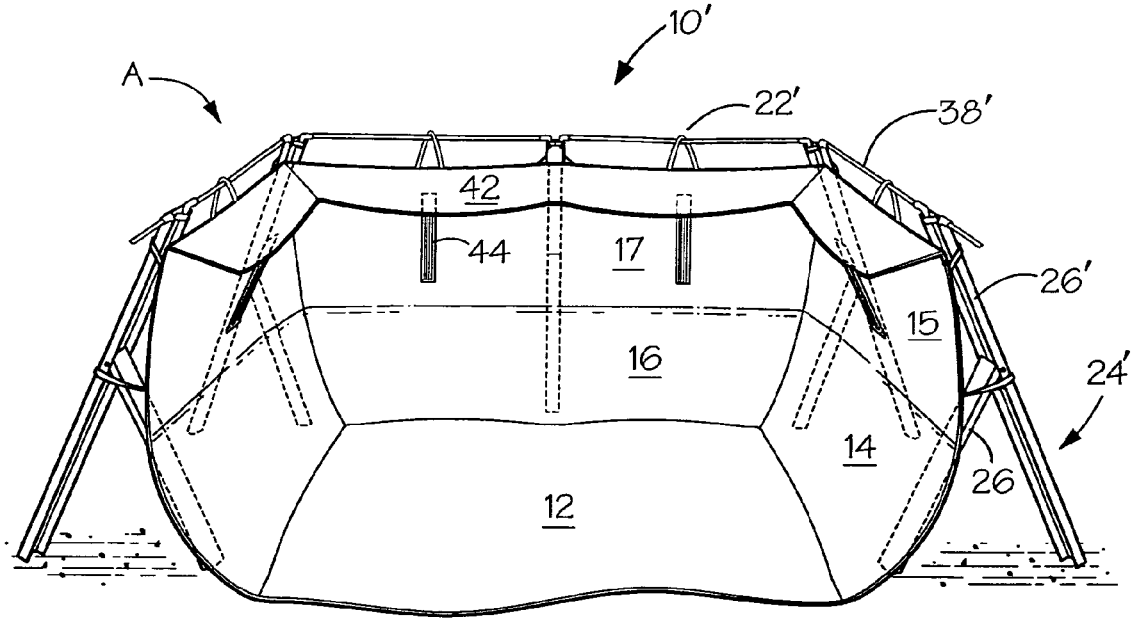
FIG. 7 is a cutaway side view of the berm arrangement shown in FIG. 6.
Figure 8:
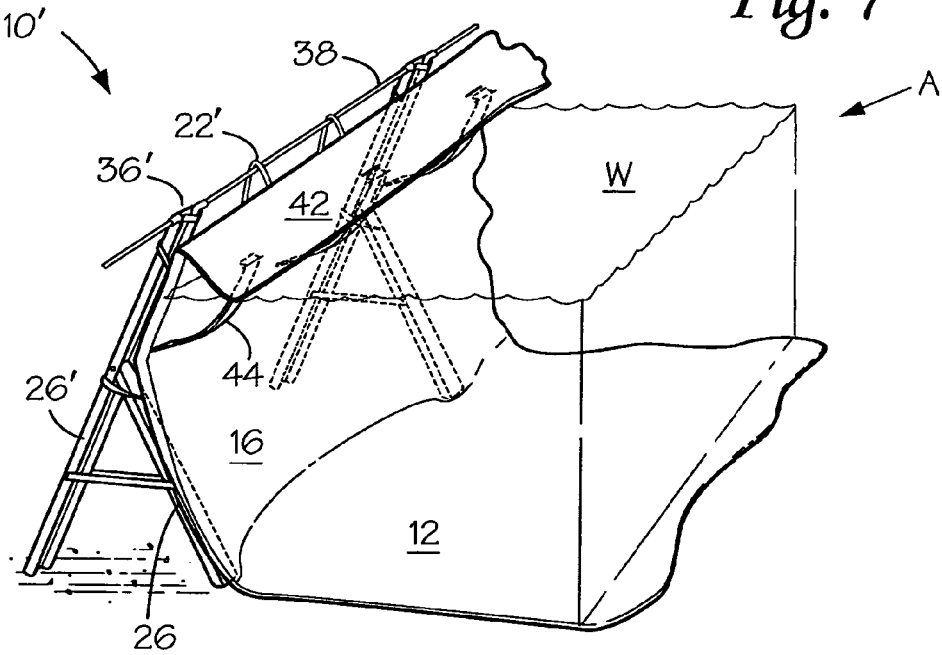
FIG. 8 is a cutaway side view similar to FIG. 7 showing the splash flap positioned relative to fluid level.

Turning now to FIGS. 7 and 8, sectional views of berm $\mathbf{10}^1$ are provided to more clearly show the relative positions of the inner surfaces of braces $\mathbf{24}^1$ and the outer surfaces of the berm. Also shown is an inwardly extending flap 42 which engages with and extends about the upper edge of extensions 15 and 17. A retaining member or strap 44 connects with extension 17 and the outer edge of flap 42 at selected locations about the containment area A. Straps 44 control the upward movement of flap 42 to generally the position shown in FIG. 8. Flap 42 is provided to prevent spillage over the upper edge of the containment area due to a sudden rush of fluid into the berm. FIG. 8 shows the level of fluid which may be contained in the berm.

Figure 9:
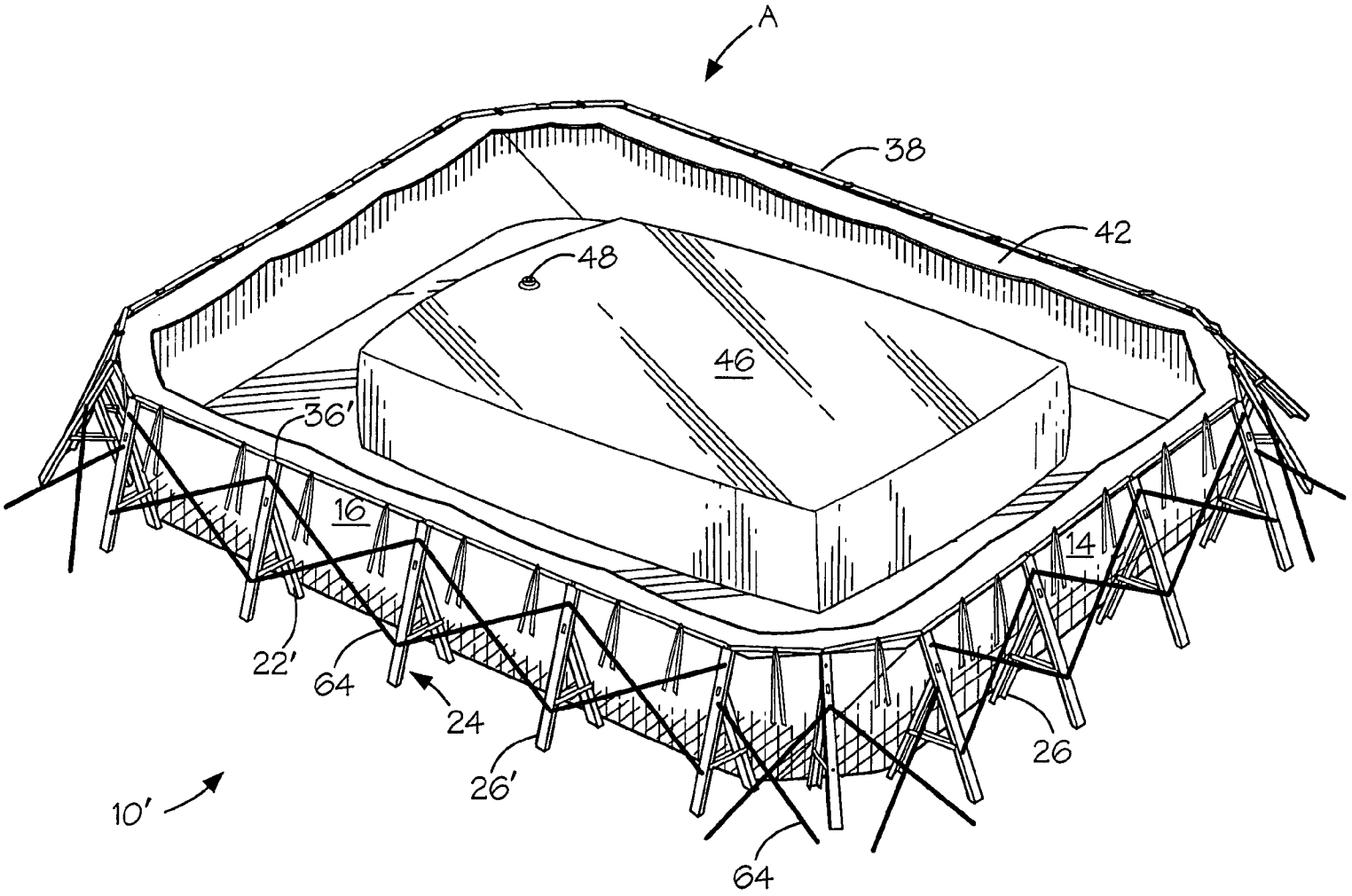
FIG. 9 is a perspective view of the arrangement shown in FIG. 6 to include a bladder positioned within the berm.

Berms 10 and $\mathbf{10}^1$ may be also employed to contain bladders such as bladder 46 shown in FIG. 9. In this arrangement, bladder 46 may be filled with water, sewage, petrochemicals or other containments in volumes of up to 500,000 gallons. The bladders are generally attached to piping through opening 48 for either filling or dispensing fluid. Due to the terrific pressure exerted by the large volume of fluid within the bladder and especially during periods of heat expansion, bladders have a tendency to rupture along their forming seams. Berm $\mathbf{10}^1$ is designed to contain the sudden rush of fluid flowing from the ruptured bladder without spillage over the walls 14, 16 of berm $\mathbf{10}^1$ due to end and side wall extensions 15, 17 and flap 42. The berm arrangement shown in FIG. 9 is another view of the berm arrangement described in FIGS. 6-8.

Bladder 46 is a known containment which generally resembles a large hot water bottle. Bladders are made in many sizes generally of an impervious flexible material similar to that forming berm 10. The construction of the bladder forms no part of the instant invention.

Figure 10A:
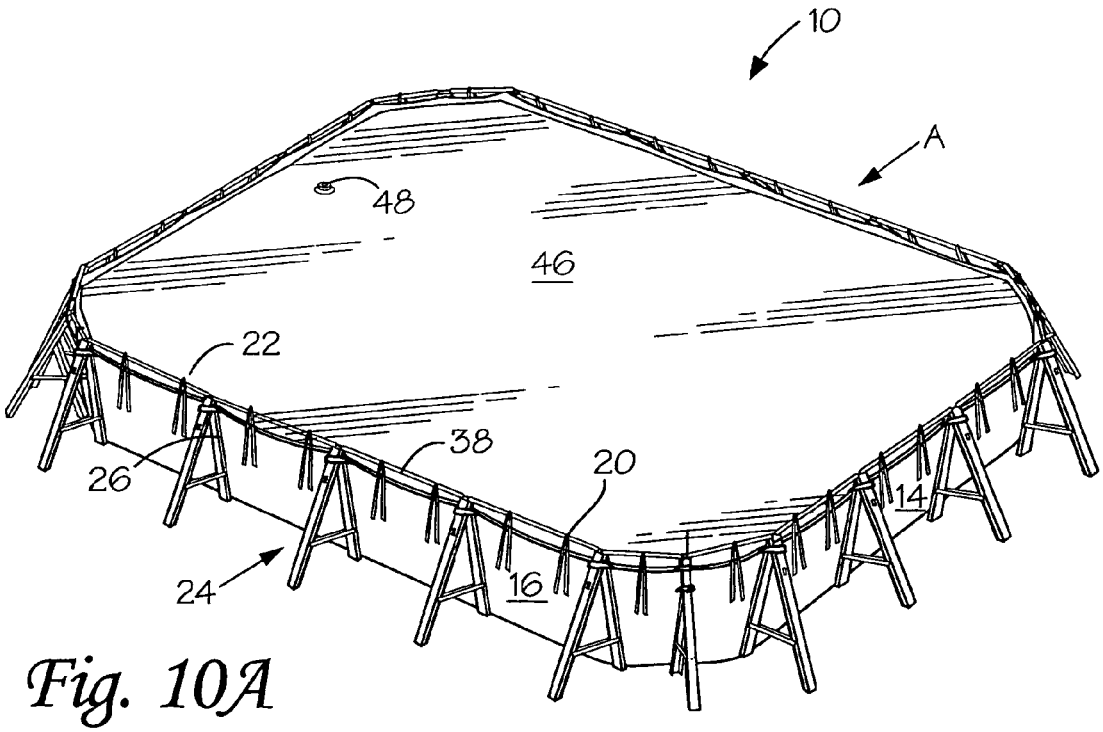
FIG. 10A is a perspective view of an arrangement in which a bladder is encased within the berm of FIG. 1.
Figure 10B:
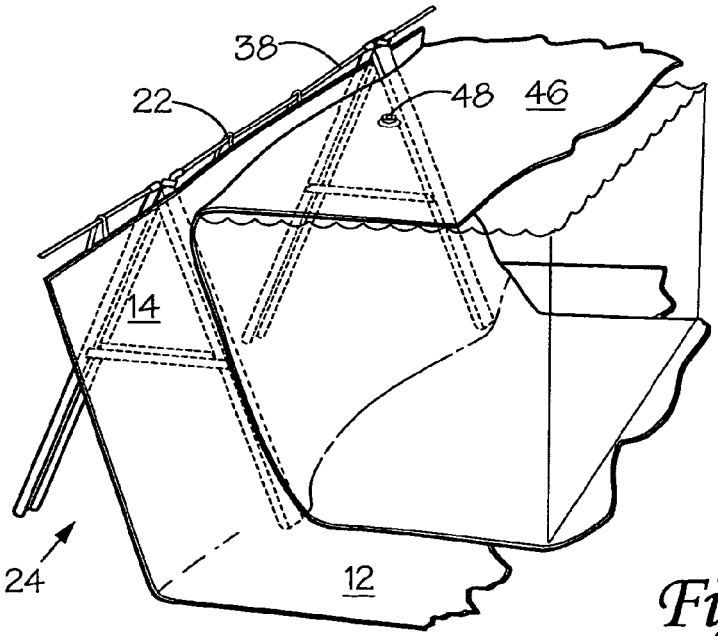
FIG. 10B is a cutaway perspective view of the arrangement of FIG. 10A showing the relative positions of the flexible material forming the berm, the support members and the bladder.
Figure 11A:
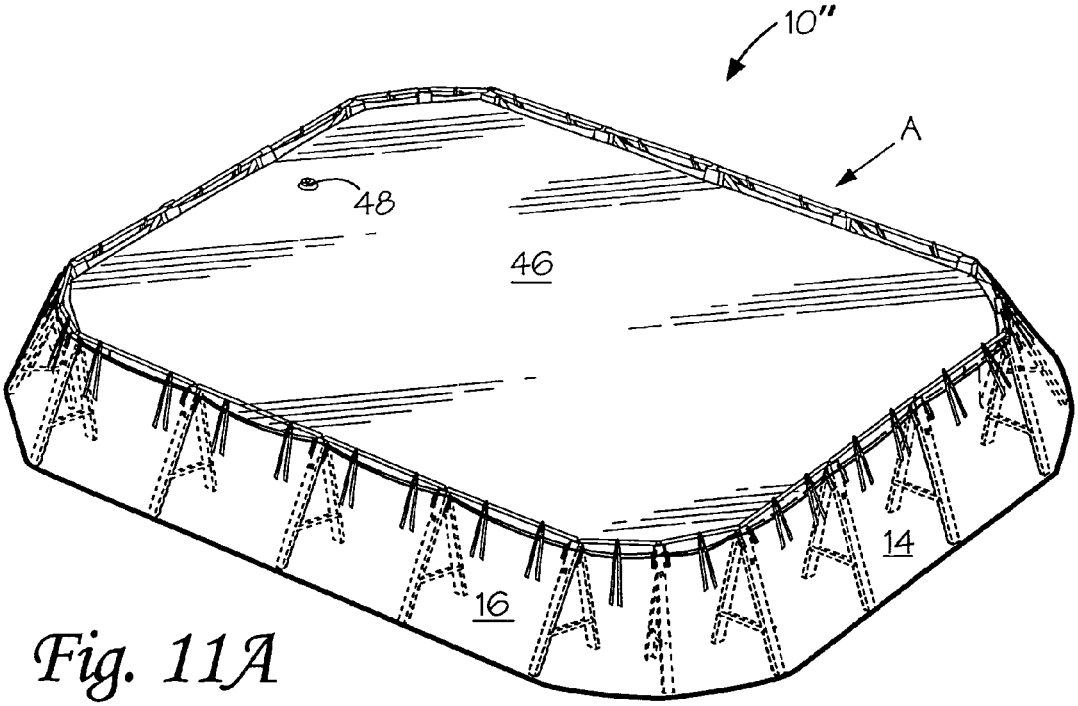
FIG. 11A is a perspective view of another arrangement in which a bladder is encased in a berm similar to that that of FIG. 1.

Turning now to FIGS. 10A and 11A, berm 10 along with berm $\mathbf{10}^1$ are shown with bladder 46 positioned in containment area A. In the arrangement shown in FIGS. 10A and 10B, berm 10 is exactly as disclosed in FIG. 1. Braces 24 are positioned about the circumference of containment area A with their inner legs 26 in engagement with side and end walls 14, 16 as previously disclosed. Positioned in juxtaposed position with side and end walls 14, 16 are the side and end wall portions of bladder 46.

The bladders, because of varying demands, are of varying sizes ranging from around 100 gallons to greater than 500,000 gallons. They may be used to contain almost any type liquid ranging from water to petrochemicals. The larger size bladders, which are comprised of a plurality of sheets of flexible non-porous material joined together with heat sealed seams, have a tendency to separate when over-filled in hot conditions due to expansion of the contained fluid. By engaging or supporting the side sections of the bladder through engagement with the inner legs of braces 24, it has been found that the tendency to separate is greatly reduced.

Figure 11B:
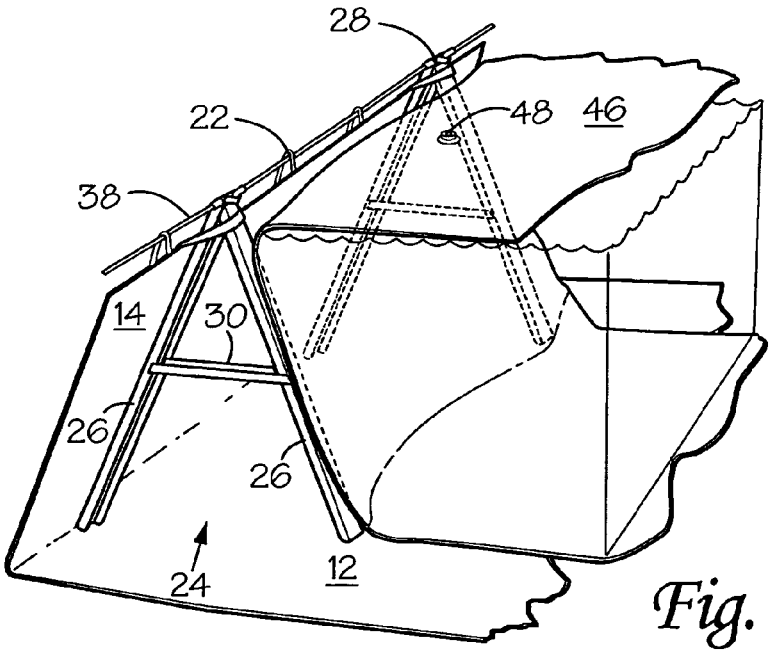
FIG. 11B is a cutaway perspective view of FIG. 11A showing the relationship of the flexible material forming the berm, the support members and the bladder.

Turning now to the arrangement shown in FIGS. 11A and 11B, the flexible sheeting forming the containment area A is exactly as described in the arrangements shown in FIGS. 1 and 10A. Braces 24 are also of the same structure. The difference is the manner of erecting berm $\mathbf{10}^{11}$ to form containment area A.

As shown in FIGS. 11A and 11B, the flexible sheeting is laid flat and braces 24 are positioned on floor 12 a distance from the outer edges equal to the height of side and end walls 14, 16. The outer portions are drawn up against outer legs 26 and connected with the upper ends of braces 24 and stabilizers 38 forming containment area A, as earlier described. Bladder 46 is then positioned in the containment area with its outer walls in contact with and supported by braces 24 as shown in FIG. 11B.

In the described condition, the berm is arranged to receive fluid for storage. The berm also may act to retain fluid which is to be removed at desired times and in desired amounts.

While a preferred embodiment of the invention has been described using specific terms, such description is for illustrative purposes only, and it is to be understood that changes and variations may be made without departing from the spirit or scope of the following claims.

What is claimed is:

1. A transportable all-terrain berm for collecting fluid comprising:

a containment area formed of flexible impervious sheeting, the containment area having a floor and surrounding walls;

a plurality of braces for supporting the walls of the containment area, each brace comprising:

a first leg having an upper end and a lower end;

a second leg having an upper end and a lower end;

a spacer securable between the first leg and the second leg above the lower ends of the first and second legs to position and maintain the lower ends of the first and second legs in spaced apart positions; and the first leg and the second leg being joined above the spacer, such that each brace comprises an A-frame;

retaining members secured to the walls of the containment area at selected spaced positions; and wherein, when the berm is set up, the braces are arranged in vertical spaced positions about the floor of the containment area and aligned with the selected spaced position of the retaining members with the upper ends of at least one of the first legs and the second legs of the braces engaged with the respectively aligned retaining members to support the walls in an upward position above the floor.

2. The transportable all-terrain berm of claim 1, wherein the first and second legs of each of the braces are pivotally joined at a pivotal connection above the spacer and the first and second legs and the spacer are collapsible together from an A-frame position into a collapsed overlapping position.

3. The transportable all-terrain berm of claim 2, wherein the first and second legs of each of the braces comprise U-shaped metal beams pivotally joined at the pivotal connection along parallel side extensions arranged in overlapping positions.

4. The transportable all-terrain berm of claim 2 wherein the first leg are longer than the second leg, the pivotal connection being adjacent the upper end of the second leg and an intermediate section of the first leg.

5. The transportable all-terrain berm of claim 4, wherein the first leg and the second leg of each of the braces are angled toward each other when in the A-frame position with the first leg extending away from the second leg below the intermediate section of the first leg and the upper end of the first leg extending above and over the second leg.

6. The transportable all-terrain berm of claim 1, wherein the retaining members comprise straps affixed to outward facing sides of the walls of the containment area for securement to the braces.

7. The transportable all-terrain berm of claim 1, further comprising support members secured to the walls of the containment area at locations between the retaining members and stabilizers extending between adjacent braces and engaging an upper area of each of the braces, the support members engaging the stabilizers between the braces to provide added support to the walls of the containment area.

8. The transportable all-terrain berm of claim 7, wherein the support members comprise at least one of straps or extended loops formed of flexible sheeting.

9. The transportable all-terrain berm of claim 1, further comprising a bladder formed of flexible impervious material and adapted to store fluid, the bladder being sized to fit into the containment area allowing the containment area to act to contain spillage from the bladder.

10. The transportable all-terrain berm of claim 9, wherein the bladder, when filled, is sized to be spaced from the walls of the containment area.

11. The transportable all-terrain berm of claim 9, wherein the bladder is sized to be engaged with and supported by the vertically extending A-frame braces.

12. The transportable all-terrain berm of claim 1, further comprising:

one or more flexible flaps at the top of the walls of the containment area, each of the one or more flaps having an outer edge directed inwardly toward an inside of the containment area, the one or more flaps being pivotable in an upward direction to prevent spillage over the top of the berm; and one or more straps connected to the one or more flaps and to inner faces of the walls of the containment area, each of the one or more straps being connected at a first end to the respective flap proximate to the outer edge of the respective flap and at a second end to the inner face of the respective wall of the containment area to limit upward movement of one or more flaps.

13. A brace for supporting the walls of a transportable all-terrain berm used for collecting fluid, the brace comprising:

a first leg having an upper end and a lower end;

a second leg having an upper end and a lower end;

a spacer securable between the first leg and the second leg above the lower ends of the first and second legs to position and maintain the lower ends of the first and second legs in spaced apart positions; and a pivotal connection pivotally joining the first leg and the second leg above the spacer, such that each brace comprises an A-frame with the lower end of the first and second legs in the spaced apart positions when the spacer is secured between the first and second legs and the first and second legs and the spacer are movable between the A-frame position and a collapsed overlapping position.

14. The brace of claim 13 wherein the first leg is longer than the second leg, the pivotal connection being adjacent the upper end of the second leg and an intermediate section of the first leg.

15. The transportable all-terrain berm of claim 14, wherein the first leg and the second leg are angled toward each other when in the A-frame position with the first leg extending away from the second leg below the intermediate section of the first leg and the upper end of the first leg extending above and over the second leg.

16. A transportable all-terrain berm for collecting fluid comprising:

a containment area formed of flexible impervious sheeting, the containment area having a floor and surrounding walls with each wall having a lower portion and an upper portion;

a plurality of braces for supporting the walls of the containment area, each brace comprising:

a first leg having an upper end, a lower end, and an intermediate section between the upper end and the lower end;

a second leg having an upper end and a lower end, the first leg being longer than the second leg; and a pivotal connection being adjacent the upper end of the second leg and the intermediate section of the first leg, the first leg and the second leg being angled toward each other when pivoted to an A-frame position with the first leg extending away from the second leg below the intermediate section of the first leg and the upper end of the first leg extending above and over the second leg;

retaining members secured to the walls of the containment area at selected spaced positions;

wherein the braces are arrangeable in vertical spaced positions about the floor of the containment area and aligned with the selected spaced position of the retaining members; and wherein the upper ends of the first legs of the braces that extend above and over the second legs are engagable with the respectively aligned retaining members to support the walls in an upward position above the floor such that the lower portions of the walls reside against the second legs of the braces and the first legs being angled away from the lower portions of the wall below the intermediate sections of the first legs and extending toward and engaging the upper portions of the walls above the intermediate sections of the first legs.

17. The transportable all-terrain berm of claim 16, wherein each of the braces further comprises a spacer securable between the first leg and the second leg above the lower ends of the first and second legs to position and maintain the lower ends of the first and second legs in the spaced part positions.

18. The transportable all-terrain berm of claim 16, wherein the retaining members comprise straps affixed to outward facing sides of the walls of the containment area and the berm further comprises hook members on the upper ends of the first legs of the braces, the straps being engageable with the hook members.

19. The transportable all-terrain berm of claim 16, further comprising support members secured to the walls of the containment area at locations between the retaining members and stabilizers extending between adjacent braces and engaging an upper area of each of the braces, the support members engaging the stabilizers between the braces to add support to the walls of the containment area.

20. The transportable all-terrain berm of claim 16, further comprising a bladder formed of flexible impervious material and adapted to store fluid, the bladder being sized to fit into the containment area allowing the containment area to act to contain spillage from the bladder.

21. The transportable all-terrain berm of claim 16, further comprising:

one or more flexible flaps at the top of the walls of the containment area, each of the one or more flaps having an outer edge directed inwardly toward an inside of the containment area, the one or more flexible flaps being pivotable in an upward direction to prevent spillage over the top of the berm; and one or more straps connected to the one or more flaps and to inner faces of the walls of the containment area, each of the one or more straps being connected at a first end to the respective flap proximate to the outer edge of the respective flap and at a second end to the inner face of the respective wall of the containment area to limit upward movement of one or more flexible flaps.

* * * * *